US007527457B2

(12) United States Patent
Moriguchi et al.

(10) Patent No.: US 7,527,457 B2
(45) Date of Patent: May 5, 2009

(54) SURFACE-COATED CUTTING TOOL

(75) Inventors: Hideki Moriguchi, Itami (JP); Haruyo Fukui, Itami (JP); Naoya Omori, Itami (JP); Shinya Imamura, Itami (JP); Makoto Setoyama, Itami (JP)

(73) Assignees: Sumitomo Electric Hardmetal Corp., Hyogo (JP); Sumitomo Electric Industries, Ltd., Osaka (JP)

( * ) Notice: Subject to any disclaimer, the term of this patent is extended or adjusted under 35 U.S.C. 154(b) by 305 days.

(21) Appl. No.: 10/593,279

(22) PCT Filed: Mar. 16, 2005

(86) PCT No.: PCT/JP2005/004656

§ 371 (c)(1),
(2), (4) Date: Sep. 18, 2006

(87) PCT Pub. No.: WO2005/089990

PCT Pub. Date: Sep. 29, 2005

(65) Prior Publication Data

US 2008/0253850 A1 Oct. 16, 2008

(30) Foreign Application Priority Data

Mar. 18, 2004 (JP) ..... 2004-078877

(51) Int. Cl.
*B23B 27/14* (2006.01)
*B32B 9/00* (2006.01)

(52) U.S. Cl. ..... 407/119; 51/307; 428/699

(58) Field of Classification Search ..... 407/119, 407/118; 428/216, 335, 698, 699, 701; 51/307, 51/309

See application file for complete search history.

(56) References Cited

U.S. PATENT DOCUMENTS

| | | | | |
|---|---|---|---|---|
| 6,447,890 | B1 * | 9/2002 | Leverenz et al. | 428/216 |
| 6,586,122 | B2 | 7/2003 | Ishikawa et al. | |
| 2002/0102403 | A1 * | 8/2002 | Leverenz et al. | 428/402 |
| 2003/0148145 | A1 | 8/2003 | Yamamoto et al. | |
| 2004/0018393 | A1 | 1/2004 | Fukui et al. | |
| 2005/0003238 | A1 * | 1/2005 | Leverenz et al. | 428/698 |

FOREIGN PATENT DOCUMENTS

| | | | |
|---|---|---|---|
| CN | 1470350 | A | 1/2004 |
| JP | 7-310174 | A | 11/1995 |
| JP | 2793773 | | 9/1998 |
| JP | 2000-326107 | A | 11/2000 |
| JP | 2000-326108 | A | 11/2000 |
| JP | 2002-331408 | A | 11/2002 |
| JP | 3347687 | | 11/2002 |
| JP | 2003-34859 | A | 2/2003 |
| JP | 2004-9267 | A | 1/2004 |
| JP | 2004-66361 | A | 3/2004 |
| JP | 2004-74361 | A | 3/2004 |
| JP | 2004-82230 | A | 3/2004 |
| JP | 2004-238736 | A | 8/2004 |
| JP | 2005-126736 | A | 5/2005 |
| JP | 2006026783 | A * | 2/2006 |

OTHER PUBLICATIONS

Chinese Office Action, with English translation, issued in Chinese Patent Application No. CN 2005800085117, mailed Dec. 14, 2007.

* cited by examiner

*Primary Examiner*—Willmon Fridie
(74) *Attorney, Agent, or Firm*—McDermott Will & Emery LLP

(57) ABSTRACT

A surface-coated cutting tool includes a base material on which formed an inner layer composed of a compound containing Al, at least one of elements Cr and V and at least one element selected from the group consisting of nitrogen, carbon and oxygen, and an outermost layer composed of a carbonitride of TiSi is further formed on the inner layer. The surface-coated cutting tool is appropriately used for such tools as drill, end mill, throwaway tips for milling and turning, metal saw, gear cutting tool, reamer, and tap. The surface-coated cutting tool improved in peeling resistance and wear resistance as compared with conventional tools can thus be provided.

12 Claims, No Drawings

SURFACE-COATED CUTTING TOOL

TECHNICAL FIELD

The present invention relates to such cutting tools as drill, end mill, throwaway tip for milling or turning, metal saw, gear cutting tool, reamer, and tap. In particular, the invention relates to a cutting tool having its surface on which a wear-resistant coating is formed.

BACKGROUND ART

In these years, the cutting machining pursues, in addition to high-speed, high-precision and high-efficiency machining, dry machining for addressing environmental issues. Further, with advances in industrial technology, some industries that frequently use difficult-to-cut materials and new materials for aircrafts, space development and nuclear power generation for example perform increasingly intense activities. It is thus expected that such materials will increase in variation in terms of quality and increase in amount. Accordingly, the cutting machining of these materials should address such increases of the materials. A number of surface-coated cutting tools that address the issue have been proposed and in actual use.

For example, Patent Document 1 discloses a hard-layer-coated tool and a hard-layer-coated member. Specifically, on a surface of such a hard base material as WC cemented carbide, cermet or high-speed steel of such a tool as cutting tool and wear-resistant tool, a hard coating layer that is an AlTiSi-based layer like $(Al_xTi_{1-x-y}Si_y)$ $(N_zC_{1-z})$ layer (where $0.05 \leqq x \leqq 0.75$, $0.01 \leqq y \leqq 0.1$, $0.6 \leqq z \leqq 1$) is formed for the purpose of improving wear resistance and surface protection function.

Patent Document 2 discloses that at least one layer of nitride, carbonitride, oxynitride or oxycarbonitride containing an appropriate amount of Si and Ti as a main component and at least one layer of nitride, carbonitride, oxynitride or oxycarbonitride containing Ti and Al as a main component are alternately formed as coating layers. Here, in the fine structure of such a compound as TiSi-based compound, $Si_3N_4$ and Si are present as independent phases in the carbonitride, oxynitride or oxycarbonitride containing Ti as a main component. It is disclosed that the performance of a cutting tool having the above-described coating and used for dry and high-speed cutting machining is considerably improved. According to Patent Document 2, as for a conventional TiAlN film, while an alumina layer that is generated through surface oxidation occurring in a cutting process serves as an oxidation protection layer for inward diffusion of oxygen, the uppermost alumina layer is insufficient for addressing advances of the oxidation since the alumina layer is readily peeled off from the porous Ti oxide layer immediately below. It is disclosed that the TiSi-based coating of the invention described in Patent Document 2 itself is highly oxidation-resistant. In addition, since the composite oxide of Ti and Si that contains Si and is highly dense is formed at the uppermost surface, no porous Ti oxide layer that is a source of the problem of the conventional art is formed, the performance is improved.

Moreover, Patent Document 3 discloses that carbonitride or nitride of AlCrV can be used to generate coating quality for cutting tools that is higher in hardness and wear resistance as compared with the TiAlN film.

Patent Document 1: Japanese Patent No. 2793773

Patent Document 2: Japanese Patent No. 3347687

Patent Document 3: Japanese Patent Laying-Open No. 2003-34859

DISCLOSURE OF THE INVENTION

Problems to be Solved by the Invention

In order to perform high-speed and high-efficiency machining or dry machining completely eliminating use of lubricating oil in a cutting process, the stability of the coating at high temperatures is insufficient. In other words, the challenge is to find how a coating having superior properties can be maintained on a surface of a base material with enough adhesion for a long period of time without occurrences of peeling and breakage.

Specifically, when cutting is performed on such a material as low-carbon steel, stainless material or ductile iron that is readily deposited on a cutting edge, the deposition of the material is likely to cause peeling of the coating and breakage due to the coating peeling is likely to occur as well. Thus, for prevention of the peeling, it is important how the deposition of the material is prevented and simultaneously an important challenge is to find how the coating property can be made superior in wear resistance.

The present invention has been made to solve the aforementioned problems, and an object of the invention is to provide a surface-coated cutting tool that is appropriately used for such tools as drill, end mill, throwaway tips for milling and turning, metal saw, gear cutting tool, reamer, and tap and that is improved in peeling resistance and wear resistance as compared with conventional tools.

MEANS FOR SOLVING THE PROBLEMS

The inventors of the present invention have conducted studies of various coatings to be formed on a surface of a tool with the purpose of solving the problems to find that, a surface-coated cutting tool with a structure having a base material coated with an inner layer formed on the base material and an outermost layer formed on the inner layer, the inner layer being composed of a compound containing Al, one or both of elements Cr and V and at least one of nitrogen, carbon and oxygen, and the outermost layer being composed of a carbonitride of TiSi, can prevent peeling of the coating while exhibiting superior wear resistance and chipping resistance, and accordingly the inventors achieve the present invention.

The invention is specifically as follows.

According to the present invention, a surface-coated cutting tool includes a base material coated with an inner layer formed on the base material and an outermost layer formed on the inner layer, the inner layer being composed of a compound containing Al, at least one of elements Cr and V and at least one element selected from the group consisting of nitrogen, carbon and oxygen, and the outermost layer being composed of a carbonitride of TiSi.

Preferably, regarding the surface-coated cutting tool of the present invention, the outermost layer has a thickness of 0.1-2 μm.

Preferably, the carbonitride of TiSi of the outermost layer has an average crystal diameter of at most 0.1 μm.

Preferably, regarding the surface-coated cutting tool of the present invention, the inner layer is composed of a compound containing $(Al_{1-a-b}Cr_aV_b)$ (where $0 \leqq a \leqq 0.5$, $0 \leqq b \leqq 0.5$, $0 \neq a+b \leqq 0.5$) and at least one of elements that are carbon, nitrogen and oxygen. Here, more preferably, the a+b satisfies $0.3<a+b<0.45$. Still more preferably, "a" has a value satisfying $0<a<0.35$ and "b" has a value satisfying $0 \leqq b \leqq 0.35$. In particular, "a" and "b" preferably have respective values satisfying $20<a/b<100$.

Preferably, regarding the surface-coated cutting tool of the present invention, the inner layer contains, in atomic percent, less than 5% of Ti.

Further, regarding the surface-coated cutting tool of the present invention, the inner layer preferably contains, in atomic percent, at most 30% of Si and/or B.

Furthermore, regarding the surface-coated cutting tool of the present invention, the surface-coated cutting tool preferably has a TiSiN layer between the base material and the inner layer and/or between the inner layer and the outermost layer.

Preferably, the inner layer is divided by a $TiSiC_xN_{1-x}$ (where $0 \leqq x \leqq 0.5$) layer. The $TiSiC_xN_{1-x}$ is preferably TiSiN.

Regarding the surface-coated cutting tool of the present invention, the base material is coated with the layers that have a total thickness of 0.5-8 μm.

EFFECTS OF THE INVENTION

According to the present invention, improvements in peeling resistance and wear resistance can be made for such tools as drill, end mill, throwaway tips for milling and turning, metal saw, gear cutting tool, reamer, and tap. Thus, the present invention can provide a surface-coated cutting tool with a long lifetime.

BEST MODES FOR CARRYING OUT THE INVENTION

A surface-coated cutting tool of the present invention includes a base material coated with an inner layer and an outermost layer formed on the inner layer. The inner layer is composed of a compound containing Al, at least one of the elements Cr and V and at least one element selected from the group consisting of nitrogen, carbon and oxygen. The outermost layer is composed of a carbonitride of TiSi (TiSiCN). The inner layer may be formed to directly cover a surface of the base material or may be formed to cover the base material with another layer (for example an innermost layer described hereinlater) therebetween. Similarly, the outermost layer may be formed to directly cover the inner layer or may be formed to cover the inner layer with another layer (for example an intermediate layer described hereinlater) therebetween.

The surface-coated cutting tool of the present invention has a feature that the base material is coated with the inner layer superior in chemical stability and exhibiting superior wear resistance in a process of cutting metal materials, wherein the inner layer is composed of the compound containing Al, at least one of the elements Cr and V and at least one element selected from the group consisting of nitrogen, carbon and oxygen. The surface-coated cutting tool of the present invention further has a feature that the inner layer is coated with the carbonitride of TiSi that has a low friction coefficient and lubricity with respect to metal materials, exhibits high chemical stability and has good adhesion with the inner layer which is composed of the compound containing Al, at least one of the elements Cr and V and at least one element selected from the group consisting of nitrogen, carbon and oxygen, and thus the outermost layer having high chemical stability is formed. The present invention with the above-described features can improve the peeling resistance and wear resistance of such tools as drill, end mill, throwaway chips for milling and turning, metal saw, gear cutting tool, reamer, and tap, so that the invention can provide the surface-coated cutting tool having a long lifetime.

Here, when the layer is composed of the compound containing Al, at least one of the elements Cr and V and at least one element selected from the group consisting of nitrogen, carbon and oxygen (for example AlCrN), the layer shows good performance in terms of high hardness and high oxidation resistance. However, through cutting evaluations, low chipping-resistance and low peeling-resistance due to occurrence of chipping were confirmed. With the purpose of overcoming this shortcoming, various studies have been conducted to find that, the inner layer composed of the above-described compound and the outermost layer composed of a carbonitride of TiSi (TiSiCN) formed on the inner layer can provide a surface-coated cutting tool improved in chipping resistance and peeling resistance. This may be for the reason that the TiSiCN of the outermost layer forms a fine-particle structure to provide a high resistance against impact in a cutting process so that the impact is alleviated to be conveyed to the inner layer and accordingly the performance is improved. It is considered that, since the adhesion between the TiSiCN or TiSiN layer and the layer composed of the compound containing Al, at least one of the elements Cr and V and at least one element selected from the group consisting of nitrogen, carbon and oxygen is remarkably excellent, the particularly superior peeling property as a property of the layer of the cutting tool can be achieved. The adhesion is especially excellent when the component defined by $(Al_{1-a-b}Cr_aV_b)$ (where $0 \leqq a \leqq 0.5$, $0 \leqq b \leqq 0.5$, $0 \neq a+b \leqq 0.5$) satisfies the condition $0.3<a+b<0.45$.

Regarding the surface-coated cutting tool of the present invention, although the thickness of the outermost layer is not particularly limited to a specific thickness, the thickness is preferably 0.1-2 μm that is more preferably 0.2-1 μm for the following reasons. When the thickness of the outermost layer is smaller than 0.1 μm, the superior effects of the outermost layer could not be exhibited. When the thickness of the outermost layer is larger than 2 μm, the coating could be likely to peel off. The thickness of the outermost layer can be measured by cutting the surface-coated cutting tool and observing the cross section with an SEM (scanning electron microscope).

According to the present invention, the outermost layer of the surface-coated cutting tool is preferably composed of a carbonitride of TiSi having an average crystal diameter of at most 0.1 μm that is more preferably at most 0.05 μm. Thus, the outer most layer that is particularly superior in lubricity as well as strength of adhesion with the inner layer can be obtained. In terms of wear resistance, the average crystal diameter of the carbonitride of TiSi forming the outermost layer is preferably at least 1 nm that is more preferably at least 3 nm. The average crystal diameter of the carbonitride of TiSi in the outermost layer of the surface-coated cutting tool can be measured for example through observation of a coating cross-section or fracture by means of an SEM or TEM.

Regarding the surface-coated cutting tool having the outermost layer composed of the carbonitride of TiSi having such a preferable average crystal diameter as the one described above, when the surface-coated cutting tool is produced through a cathode arc ion plating process for example that is described hereinlater, the outermost layer is preferably formed under the condition that the base-material bias voltage is in the range of −150 to −10 V.

The surface-coated cutting tool of the present invention has the inner layer that is composed of a compound containing Al, at least one of the elements Cr and V and at least one element selected from the group consisting of nitrogen, carbon and oxygen, as described above. The compound forming the inner layer may contain any element other than those described above (for example Ti, Si, B described hereinlater) to the extent that does not spoil the effects of the present invention. According to the present invention, as the inner layer contains Al, the oxidation-resistant property is improved and the thermal conductivity is enhanced. An effect accordingly obtained is that the heat generated in a cutting process can be released from the surface of the tool.

Regarding the compound of which the inner layer of the invention is composed, the contents of Cr and V except for Al are preferably defined by ($Al_{1-a-b}Cr_aV_b$) (where $0 \leqq a \leqq 0.5$, $0 \leqq b \leqq 0.5$, $0 \neq a+b \leqq 0.5$). More specifically, the inner layer of the surface-coated cutting tool of the present invention is preferably composed of at least a compound containing ($Al_{1-a-b}Cr_aV_b$) (where $0 \leqq a \leqq 0.5$, $0 \leqq b \leqq 0.5$, $0 \neq a+b \leqq 0.5$) and at least one of carbon, nitrogen and oxygen, for the following reason. Regarding ($Al_{1-a-b}Cr_aV_b$), when at least one of a and b is larger than 0.5, the hardness of the inner layer could decrease and accordingly wear resistance could not sufficiently be exhibited. Especially preferable wear resistance is achieved when the condition $0.3<a+b<0.45$ is satisfied. The value determined by a+b that is in this range is preferable since adhesion with a TiSiCN layer of an outermost layer or a TiSiN layer of an intermediate layer is improved so that the coating has superior peeling resistance. Further, regarding ($Al_{1-a-b}Cr_aV_b$), preferably the value of a satisfies the condition $0<a<0.35$ and the value of b satisfies the condition $0<b<0.35$, since excellent peeling resistance can be expected from the fact that Cr and V are contained simultaneously and respective values of a and b are both less than 0.35. Although the reason therefor is not clarified, it is presumed that lubricity of Cr at low temperatures and lubricity of V in a relatively high temperature range can be improved and Cr and V that are simultaneously contained provide the excellent peeling resistance over a wide range of cutting conditions. Moreover, it is particularly preferable that the values of a and b have the relation $20<a/b<100$. Regarding the surface-coated cutting tool, the composition of the compound of which the inner layer is composed can be identified by an X-ray photoelectron spectroscope (XPS) or Auger electron spectroscope (AES).

Regarding the surface-coated cutting tool having the inner layer composed of the preferable compound with the contents of Cr and V except for Al expressed by ($Al_{1-a-b}Cr_aV_b$) (where $0 \leqq a \leqq 0.5$, $0 \leqq b \leqq 0.5$, $0 \neq a+b \leqq 0.5$), when the surface-coated cutting tool is produced through a cathode arc ion plating process for example that is discussed hereinlater, the inner layer can be formed under the condition that the base-material bias voltage is in the range of −300 to −20 V for example. In particular, the surface-coated cutting tool having the inner layer composed of the preferred compound expressed by ($Al_{1-a-b}Cr_aV_b$) where the values of a and b have the relation $20<a/b<100$ can be achieved by setting the base-material bias voltage in the range of −250 to −40 V in the process of manufacturing the surface-coated cutting tool.

Regarding the surface-coated cutting tool of the present invention, although the thickness of the inner layer is not limited to a particular one, preferably the thickness is 0.4 to 8 μm that is more preferably 1 to 6 μm. When the thickness of the inner layer is less than 0.4 μm, the wear resistance could be insufficient. When the thickness of the inner layer is larger than 8 μm, the breakage resistance could be deteriorated. As the outermost layer described above, the thickness of the inner layer can be measured by cutting the surface-coated cutting tool and observing the cross section by means of an SEM.

For the purpose of further enhancing adhesion between the outermost layer and the inner layer, the inner layer preferably contains a small amount of Ti. Specifically, the inner layer preferably contains, in atomic percent, less than 5% of Ti that is more preferably less than 3%. When the inner layer contains, in atomic percent, 5% or more of Ti, there is a tendency that the wear resistance of the inner layer is deteriorated. For allowing the effect of the improved adhesion between the outermost layer and the inner layer to be exhibited sufficiently, Ti contained in the inner layer is preferably at least 0.01% in atomic percent that is more preferably at least 0.1%. Here, the content of Ti in the inner layer of the surface-coated cutting tool can be measured for example by means of an XPS.

A TiSiN layer (intermediate layer) may be included between the inner layer and the outermost layer. The presence of the intermediate layer between the inner layer and the outermost layer further improves adhesion between the outermost layer and the inner layer. Although the thickness of the intermediate layer is not limited to a particular one, the thickness is preferably 0.05 to 2.0 μm that is more preferably 0.1 to 1.5 μm. When the thickness of the intermediate layer is less than 0.05 μm, the effect of the improved adhesion could not sufficiently be exhibited. When the thickness of the intermediate layer is larger than 2.0 μm, the wear resistance could be deteriorated. As the outermost layer described above, the thickness of the intermediate layer can be measured by cutting the surface-coated cutting tool and observing the cross section by means of an SEM. It is noted that the conditions that the inner layer contains less than 5% in atomic percent of Ti and the intermediate layer of TiSiN is included between the inner layer and the outermost layer, as described above, are particularly preferable in terms of improvement in adhesion as discussed above.

Further, regarding the surface-coated cutting tool of the present invention, for the purpose of improving adhesion between the inner layer and the base material, a TiSiN layer (innermost layer) may be included between the inner layer and the base material. Although the thickness of the innermost layer is not limited to a particular one, the thickness is preferably 0.01 to 1.0 μm that is more preferably 0.05 to 0.5 μm. When the thickness of the innermost layer is less than 0.01 μm, the effect of the improvement in adhesion could not sufficiently be exhibited. When the thickness of the innermost layer is larger than 1.0 μm, the wear resistance could be deteriorated. As the outermost layer described above, the thickness of the innermost layer can be measured by cutting the surface-coated cutting tool and observing the cross section by means of an SEM or TEM.

Furthermore, regarding the surface-coated cutting tool of the present invention, when the inner layer is divided into multiple layers by a $TiSiC_xN_{1-x}$ (where $0 \leqq x \leqq 0.5$) layer, excellent peeling resistance can be achieved. Here, the division of the inner layer means that the inner layer is divided into layers that are each almost in parallel with the surface of the base material. When the inner layer is divided by the $TiSiC_xN_{1-x}$ layer and a large stress is suddenly applied in a cutting process, some layers of the multi-layer could be broken at the interface therebetween at which the bonding strength is low. Thus, the breakage of the inner layer in the cutting process occurs at the smaller layer as compared with the original non-divided inner layer. Accordingly, a sudden large-scale breakage of the layer can be prevented and consequently the stable and extended lifetime of the surface-coated cutting tool can be achieved. Here, the reason why x in $TiSiC_xN_{1-x}$ is defined by $0 \leqq x \leqq 0.5$ is that x larger than 0.5 causes adhesion between the $TiSiC_xN_{1-x}$ layer and the inner layer to be deteriorated excessively, resulting in deterioration in wear resistance. It is particularly preferable that the value of x is 0 (namely TiSiN) since the adhesion between the TiSiN layer and the inner layer is relatively superior and thus relatively superior wear resistance can be maintained.

When the inner layer is divided into multiple layers by the $TiSiC_xN_{1-x}$ layer, the number of layers produced by dividing the inner layer is not limited to a particular one. Respective thicknesses of the layers of the inner layer may be equal to or different from each other. When the inner layer is divided into layers having different thicknesses respectively, it is advantageous that various breaking stresses can be addressed. Although the thickness of the layers in the inner layer is not limited to a particular one, it is preferable that all layers of the inner layer that are produced by dividing the inner layer each have a thickness in the range of 0.01 to 1.0 μm and the total thickness of the layers in the inner layer is in the above-described range of the thickness of the inner layer. When any layer in the inner layer has a thickness less than 0.01 μm, the wear resistance could be insufficient. When any layer in the inner layer has a thickness larger than 1.0 μm, the advantage derived from dividing the inner layer could be deteriorated. As the outermost layer described above, the thickness of the layers in the inner layer can be measured by cutting the surface-coated cutting tool and observing the cross section by means of an SEM or TEM.

Further, when the inner layer is divided by the $TiSiC_xN_{1-x}$ layer into multiple layers, the thickness of the $TiSiC_xN_{1-x}$ layer (when a plurality of $TiSiC_xN_{1-x}$ layers are formed, the thickness of the layers each) is preferably 1 to 200 nm that is more preferably 10 to 100 nm. When the thickness of the $TiSiC_xN_{1-x}$ layer is less than 1 nm, the advantage derived from the division of the inner layer into multiple layers could be deteriorated. When the thickness of the $TiSiC_xN_{1-x}$ layer is larger than 200 nm, the wear resistance could be deteriorated. As the outermost layer described above, the thickness of the $TiSiC_xN_{1-x}$ layer can be measured by cutting the surface-coated cutting tool and observing the cross section by means of an SEM or TEM.

In terms of improvements in oxidation resistance, wear resistance and peeling resistance of the surface-coated cutting tool, the inner layer may preferably contain, in atomic percent, at most 30% of Si that is more preferably at most 20% that is still more preferably at most 15%. When the inner layer contains Si, a finer structure of the inner layer is achieved and the hardness of the inner layer is enhanced. Moreover, the presence of Si in the inner layer improves adhesion between the inner layer and the outermost layer composed of TiSiCN. However, the content of Si in the inner layer that exceeds 30% in atomic percent is not preferred since the inner layer becomes brittle and undesirably wear is promoted. When the inner layer contains Si, for the purpose of obtaining the effect of finer structure, preferably at least 1% in atomic percent of Si is contained that is more preferably at least 5%. Here, the content of Si in the inner layer of the surface-coated cutting tool can be measured for example by a XPS or AES.

Moreover, the inner layer may preferably contain, in atomic percent, at most 30% of B that is more preferably at most 15% that is still more preferably at most 10%. The presence of B in the inner layer provides the advantages that the coating has a high hardness and that an oxide of B generated through surface oxidation in a cutting process particularly makes an oxide of Al denser. Further, since the oxide of B has a low melting point, the B oxide serves as lubricating oil in a cutting process to provide an advantage of superior peeling resistance. However, the content of B in the inner layer that exceeds 30% is not preferred since the wear resistance is undesirably deteriorated. Furthermore, when the inner layer contains B, for the purpose of improving the wear resistance and peeling resistance, preferably at least 1% in atomic percent of B is contained that is more preferably at least 5%. The content of B in the inner layer of the surface-coated cutting tool can be measured for example by means of a XPS.

Regarding the surface-coated cutting tool of the present invention, preferably the inner layer has a residual stress of −6 to 0 GPa that is more preferably −4 to −1 GPa. When the residual stress is less than −6 GPa, compressive residual stress in the surface coating is too large and consequently the strength of adhesion with the base material tends to decrease. When the residual stress exceeds 0 GPa, tensile stress remains in the coating. As a result, cracks are likely to open in the coating and chipping resistance and breakage resistance could be deteriorated. The residual stress can be measured for example by means of an X-ray residual stress measuring device or $Sin^2 \psi$ method.

The surface-coated cutting tool having the above-described preferable residual stress can be implemented in the following way. When the surface-coated cutting tool is produced for example through a cathode arc ion plating process as described hereinlater, the inner layer is formed on the condition that the base-material bias voltage for example is in the range of −300 to −20 V.

Further, regarding the surface-coated cutting tool of the present invention, the layers with which the base material is coated (the layers are the inner layer, the outermost layer, and the intermediate layer if the intermediate layer is formed) preferably have a total thickness of 0.5 to 8 μm that is more preferably 1.0 to 6.0 μm. When the total thickness is smaller than 0.5 μm, the wear resistance could not sufficiently be improved. When the total thickness exceeds 8 μm, it could occur that the residual stress in the layers covering the base material is large to cause the strength of adhesion with the base material to decrease. As the thickness of the outermost layer as described above, the total thickness can be measured by cutting the surface-coated cutting tool and observing the cross section by means of an SEM.

As the base material used for the surface-coated cutting tool of the present invention, any material that has been used widely in the art may appropriately be employed, and the base material is not limited to a particular one. However, the base material is preferably any of WC cemented carbide, cermet, high-speed steel, ceramics (silicon carbide, silicon nitride, aluminum nitride, aluminum oxide, silicon carbide, titanium carbide and a composite thereof), sintered cubic boron nitride, and sintered diamond, since such materials have high hardness at high temperatures. In particular, preferably WC cemented carbide, cermet or sintered cubic boron nitride is used as the base material.

The surface-coated cutting tool of the present invention is applicable to various known cutting tools that are used for cutting machining. In particular, the coated cutting tool of the present invention is preferably any of drill, end mill, throw-away chip for milling and turning, meal saw, gear cutting tool, reamer, and tap.

The surface-coated cutting tool of the present invention can be manufactured through a known film-deposition process with which a compound of high crystallinity can be produced and in which the base material is coated with the inner layer and the outermost layer (the innermost layer, the intermediate layer and the like depending on cases). As the film deposition process, physical vapor deposition is preferred since compressive stress can be applied into the coating. The physical vapor deposition includes for example ion plating, sputtering and electron beam vapor deposition. When the surface-coated cutting tool of the present invention is manufactured and the ion plating is employed, arc ion plating is preferable since adhesion with the base material is readily ensured. When the sputtering is employed, magnetron sputtering (balanced and unbalanced magnetron sputtering) is preferable since it is excellent in coating of a non-electrically-conductive material. Among them, the cathode ion plating with a high ion ratio of elements is particularly preferred. When the cathode arc ion plating is used, a metal ion bombardment process for the surface of the base material can be carried out before the inner layer is formed so that the adhesion of the inner layer is remarkably improved.

Using examples, how the wear resistance of the surface-coated cutting tool is improved is specifically described now. The composition in the examples was identified by means of an X-ray photoelectron spectroscope (XPS) and an Auger electron spectroscope (AES).

EXAMPLES 1-8

COMPARATIVE EXAMPLES 1-3

As a base material, a cemented carbide with its grade of K20 defined by the JIS and a tip with the shape of SPGN1020308 defined by the JIS were used and they were mounted on a cathode arc ion plating apparatus.

First, a vacuum pump was used to decrease the pressure in a chamber while a heater provided in the apparatus was used to heat the base material to a temperature of 650° C. The vacuum was generated until the pressure in the chamber reaches $1.0\times10^{-4}$ Pa. Then, argon gas was supplied and the pressure in the chamber was kept at 3.0 Pa. While the voltage of a base-material bias voltage source was gradually increased to reach −1500 V, the surface of the base material was cleaned for 15 minutes. After this, the argon gas was discharged.

Next, in order for the composition of the compound of the inner layer to be any shown in Table 1, an alloy target that is the source of metal evaporation was set. As the reaction gas, any of nitrogen, methane and oxygen that would allow the coating of the present invention to be generated was supplied. While the base-material temperature of 650° C., the reaction-gas pressure of 2.0 Pa and the base-material bias voltage of −100 V were kept, arc current of 100 A was supplied to a cathode electrode to generate metal ions from the arc evaporation source and thereby form a coating (inner layer). When the inner layer had any of the predetermined thicknesses shown in Table 1, the electric current supplied to the evaporation source was stopped.

Successively, on the inner layer, an outermost layer that was a TiSiCN layer was formed. Specifically, Ti and Si were set within the chamber. While nitrogen and oxygen were supplied thereinto as reaction gasses, the base-material temperature was set at 650° C., the reaction-gas pressure was set at 2.0 Pa and the base-material bias voltage was set at −50 V. Then, arc current of 100 A was supplied to the cathode electrode to cause metal ions to be generated from the arc evaporation source. Accordingly, the outermost layer of the carbonitride of TiSi having an average crystal diameter of 0.05 μm was formed. When the outermost layer had a predetermined thickness, the electric current supplied to the evaporation source was stopped, and gradual cooling was done.

Regarding Examples 5 to 7 and Comparative Example 2, before the inner layer was formed, an innermost layer that was a TiSiN layer was formed on the base material. Specifically, Ti and Si were set within the chamber, while nitrogen was supplied thereinto as reaction gas, the base-material temperature of 650° C., the reaction-gas pressure of 2.0 Pa and the base-material bias voltage of −100 V were maintained. Then, arc current of 100 A was supplied to the cathode electrode to cause metal ions to be generated from the arc evaporation source and thereby form the innermost layer. When the innermost layer had a predetermined thickness, the electric current supplied to the evaporation source was stopped.

Regarding Example 7, after the inner layer was formed and before the outermost layer was formed, an intermediate layer that was a TiSiN layer was formed in the same manner as that for the innermost layer.

Further, regarding Example 8, the outermost layer was formed by setting the base-material bias voltage at −30 V so that the outermost layer (TiSiCN layer) composed of a carbonitride of TiSi with an average crystal diameter of 0.3 μm was generated.

On the products of Examples 1 to 8 and Comparative Examples 1 to 3 obtained through the above-described processes, dry milling tests were conducted under the following conditions to measure the time taken for the flank at the cutting edge to be worn by a width exceeding 0.2 mm. The cutting conditions were that a material to be cut was SUS304 stainless steel (HB=180), the cutting speed was 70 m/min, the feed per revolution was 0.2 mm/rev and the depth of cut was 1 mm. The results are shown in Table 1.

TABLE 1

| | innermost layer | inner layer | intermediate layer | outermost layer | a/b | a + b | time (min) *1 V100 | V300 |
|---|---|---|---|---|---|---|---|---|
| Example 1 | — | $Al_{0.6}Cr_{0.4}N$ (2 μm) | — | TiSiCN (0.7 μm) | — | 0.4 | 45 | 10 |
| Example 2 | — | $Al_{0.69}Cr_{0.29}V_{0.02}N$ (2 μm) | — | TiSiCN (0.5 μm) | 14.5 | 0.31 | 56 | 15 |
| Example 3 | — | $Al_{0.65}Cr_{0.21}V_{0.1}Si_{0.04}N$ (5 μm) | — | TiSiCN (1.3 μm) | 2.1 | 0.31 | 63 | 19 |
| Example 4 | — | $Al_{0.68}V_{0.32}C_{0.1}N_{0.9}$ (3 μm) | — | TiSiCN (0.3 μm) | — | 0.32 | 34 | 17 |
| Example 5 | TiSiN (0.2 μm) | $Al_{0.6}Cr_{0.4}N$ (2 μm) | — | TiSiCN (0.5 μm) | — | 0.4 | 56 | 12 |
| Example 6 | TiSiN (0.4 μm) | $Al_{0.55}Cr_{0.35}V_{0.05}Ti_{0.05}C_{0.2}N_{0.8}$ (2 μm) | — | TiSiCN (1.5 μm) | 7 | 0.4 | 61 | 20 |
| Example 7 | TiSiN (0.3 μm) | $Al_{0.65}Cr_{0.3}V_{0.04}Ti_{0.01}C_{0.05}N_{0.9}O_{0.05}$ (2 μm) | TiSiN (0.2 μm) | TiSiCN (0.3 μm) | 7.7 | 0.34 | 70 | 18 |
| Example 8 | — | $Al_{0.6}Cr_{0.4}N$ (2 μm) | — | TiSiCN (0.7 μm) | — | 0.4 | 38 | 7 |
| Comparative Example 1 | — | $TiC_{0.5}N_{0.5}$ (2 μm) | — | — | — | — | 11 | 2 |
| Comparative Example 2 | TiSiN (0.5 μm) | $TiC_{0.5}Al_{0.5}N$ (2 μm) | — | TiSiCN (0.8 μm) | — | — | 17 | 3 |
| Comparative Example 3 | — | $Al_{0.6}Cr_{0.4}N$ (2 μm) | — | — | — | 0.4 | 13 | 5 |

*1: time for which cutting can be done

As clearly seen from Table 1, according to the present invention, the lifetime of the cutting tools of Examples 1 to 8 each was remarkably improved relative to Comparative Examples 1 to 3 when used for cutting SUS304 by which coating peeling is likely to occur.

EXAMPLES 9-12

Surface-coated cutting tools of the present invention were produced in the same manner as that for Example 1 discussed above except that the inner layer and the outermost layer with the compositions shown in Table 2 were formed. As described above, cutting tests were conducted on Examples 9 to 12 to find the performance as shown in Table 2.

TABLE 2

| | innermost layer | inner layer | intermediate layer | outermost layer | a/b | a + b | time (min) *1 V100 | V300 |
|---|---|---|---|---|---|---|---|---|
| Example 9 | — | $Al_{0.655}Cr_{0.33}V_{0.015}N$ (2 μm) | — | TiSiCN (0.5 μm) | 22 | 0.345 | 67 | 25 |
| Example 10 | — | $Al_{0.632}Cr_{0.36}V_{0.008}N$ (2 μm) | — | TiSiCN (0.5 μm) | 45 | 0.368 | 70 | 24 |
| Example 11 | — | $Al_{0.636}Cr_{0.36}V_{0.004}N$ (2 μm) | — | TiSiCN (0.5 μm) | 90 | 0.364 | 72 | 23 |
| Example 12 | TiSiN (0.4 μm) | $Al_{0.643}Cr_{0.35}V_{0.007}N$ (2 μm) | — | TiSiCN (0.5 μm) | 50 | 0.357 | 77 | 26 |

*1: time for which cutting can be done

As shown in Table 2, Examples 9 to 12 having the inner layer composed of the compound $(Al_{1-a-b}Cr_aV_b)$ where the values of a and b satisfy the relation 5<a/b<100 are especially superior in cutting-tool lifetime.

EXAMPLE 13

An inner layer of the same composition as that of Example 6 was formed in the same manner except that the process of forming the inner layer and the process of forming a TiSiN layer similar to the formation of the innermost layer were carried out alternately to produce a surface-coated cutting tool having the inner layer divided into 15 layers by the TiSiN layer of 0.05 μm in thickness. The layers in the inner layer as divided had the same thickness of 0.2 μm. On the resultant Example 13, a cutting test was conducted in the same manner as that described above. Accordingly, the performance shown in Table 3 was found.

TABLE 3

| | innermost layer | inner layer | intermediate layer | outermost layer | a/b | a + b | time (min) *1 V100 | V300 |
|---|---|---|---|---|---|---|---|---|
| Example 13 | TiSiN (0.4 μm) | $Al_{0.55}Cr_{0.35}V_{0.05}Ti_{0.05}C_{0.2}N_{0.8}$ (0.2 μm) (divided into 15 layers by TiSiN layer (0.05 μm)) | — | TiSiCN (1.5 μm) | 7 | 0.4 | 85 | 28 |

*1: time for which cutting can be done

From Table 3, it can be confirmed that Example 13 having the inner layer divided by the TiSiN layer was remarkably superior in cutting-tool lifetime.

It should be noted that the embodiments and examples disclosed here are by of illustration and example only and are not to be taken by way of limitation. It is intended that the scope of the present invention is limited not by the description above but by the scope of the appended claims, and covers all modifications and variations within the meaning and the scope equivalent to those of the claims.

The invention claimed is:

1. A surface-coated cutting tool, comprising:

a base material coated with an inner layer formed on the base material and an outermost layer formed on the inner layer, wherein the inner layer being composed of a compound containing Al, at least one of elements Cr and V and at least one element selected from the group consisting of nitrogen, carbon and oxygen, the outermost layer being composed of a carbonitride of TiSi, and the surface-coated cutting tool has a TiSiN layer between the base material and the inner layer and/or between the inner layer and the outermost layer.

2. The surface-coated cutting tool according to claim 1, wherein the outermost layer has a thickness of 0.1-2 μm.

3. The surface-coated cutting tool according to claim 1, wherein the carbonitride of TiSi has an average crystal diameter of at most 0.1 μm.

4. The surface-coated cutting tool according to claim 1, wherein said inner layer is composed of a compound containing $(Al_{1-a-b}Cr_aV_b)$ (where $0 \leqq a \leqq 0.5$, $0 \leqq b \leqq 0.5$, $0 \neq a+b \leqq 0.5$) and at least one of elements that are carbon, nitrogen and oxygen.

5. The surface-coated cutting tool according to claim 4, wherein said a+b satisfies $0.3 \leqq a+b \leqq 0.45$.

6. The surface-coated cutting tool according to claim 4, wherein said a has a value satisfying $0 \leqq a \leqq 0.35$ and said b has a value satisfying $0 \leqq b \leqq 0.35$.

7. The surface-coated cutting tool according to claim 4, wherein said a and b have respective values satisfying $20 \leqq a/b \leqq 100$.

8. The surface-coated cutting tool according to claim 1, wherein the inner layer contains, in atomic percent, less than 5% of Ti.

9. The surface-coated cutting tool according to claim 1, wherein the inner layer contains, in atomic percent, at most 30% of Si and/or B.

10. The surface-coated cutting tool according to claim 1, wherein the inner layer is divided by a $TiSiC_xN_{1-x}$ (where $0 \leqq x \leqq 0.5$) layer.

11. The surface-coated cutting tool according to claim 10, wherein said $TiSiC_xN_{1-x}$ is TiSiN.

12. The surface-coated cutting tool according to claim 1, wherein the base material is coated with the layers that have a total thickness of 0.5-8 μm.

* * * * *